US008139931B1

(12) United States Patent
Griffin

(10) Patent No.: US 8,139,931 B1
(45) Date of Patent: Mar. 20, 2012

(54) METHOD AND APPARATUS FOR PREVENTING ICE FORMATION IN A WET SAW BASIN

(76) Inventor: Allen P. Griffin, Denver, CO (US)

( * ) Notice: Subject to any disclaimer, the term of this patent is extended or adjusted under 35 U.S.C. 154(b) by 351 days.

(21) Appl. No.: 12/437,107

(22) Filed: May 7, 2009

(51) Int. Cl.
*H05B 3/78* (2006.01)

(52) U.S. Cl. ..... 392/500; 392/441; 219/221

(58) Field of Classification Search ..... 392/441, 392/500; 219/221
See application file for complete search history.

(56) References Cited

U.S. PATENT DOCUMENTS 2,472,178 A 6/1949 Temple
4,835,366 A 5/1989 Owen et al.
6,347,624 B1 2/2002 Smith et al.
6,494,198 B1 12/2002 Chen
D479,539 S 9/2003 Chen
6,782,882 B1 8/2004 Chen

OTHER PUBLICATIONS http://www.contractortalk.com/f73/wet-saw-anti-freeze-48500/—Nov. 20, 2008.*
http://www.johnbridge.com/vbulletin/archive/index.php/t-22861.html—Apr. 28, 2005.*

* cited by examiner

*Primary Examiner* — Thor Campbell

(57) ABSTRACT

A saw bath ice formation preventing method includes the positioning of a heating member in a basin having water positioned therein. A wet saw is mounted to the basin. The heating element is turned on when the wet saw is being used in temperatures below 0° Celsius to prevent the water from freezing.

4 Claims, 5 Drawing Sheets

METHOD AND APPARATUS FOR PREVENTING ICE FORMATION IN A WET SAW BASIN

BACKGROUND OF THE DISCLOSURE

Field of the Disclosure

The disclosure relates to ice preventing methods and more particularly pertains to a new ice preventing method for allowing operation of a wet saw in freezing temperatures.

SUMMARY OF THE DISCLOSURE

An embodiment of the disclosure meets the needs presented above by generally comprising the positioning of a heating member in a basin having water positioned therein. A wet saw is mounted to the basin. The heating element is turned on when the wet saw is being used in temperatures below 0° Celsius to prevent the water from freezing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
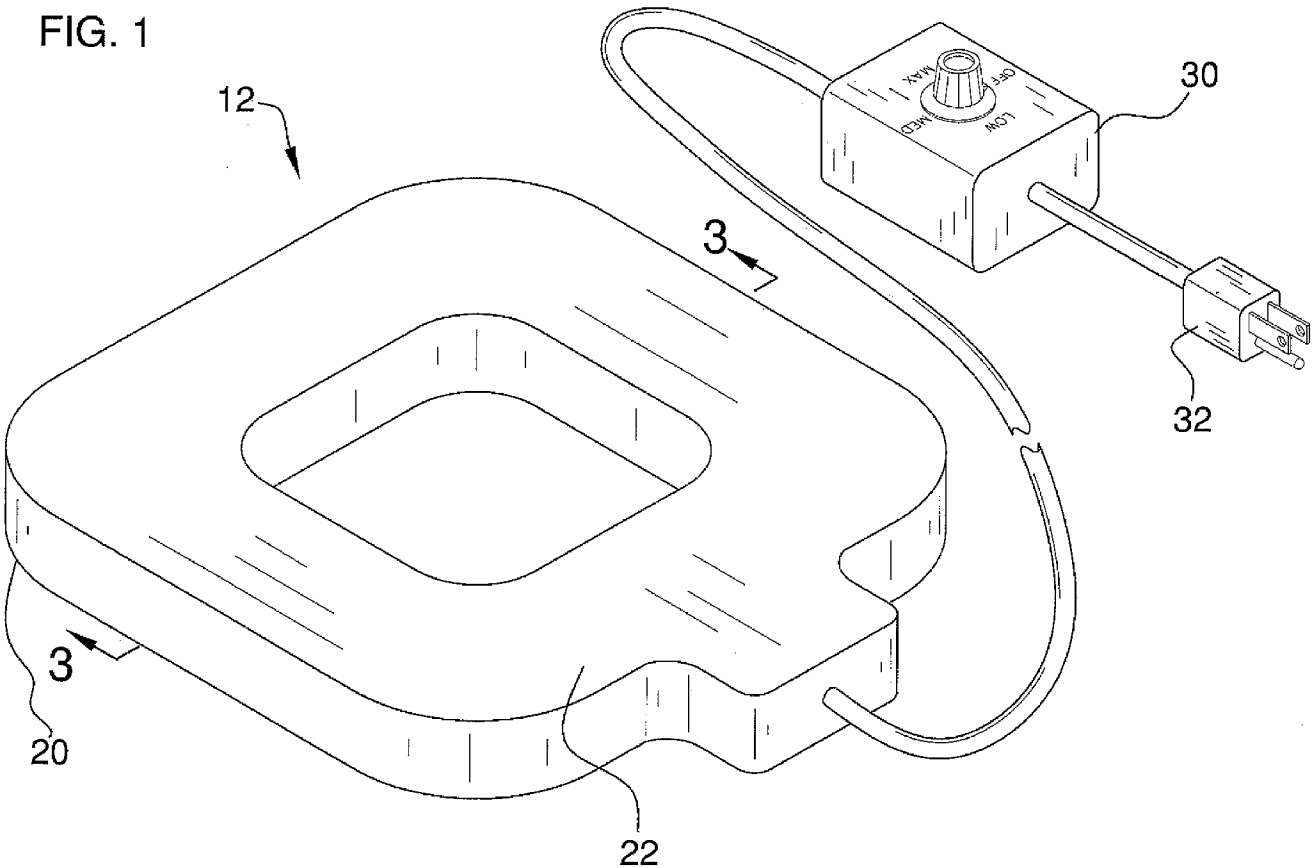
FIG. 1 is a top perspective view of a heating member of a saw bath ice formation preventing method according to an embodiment of the disclosure.
Figure 2:
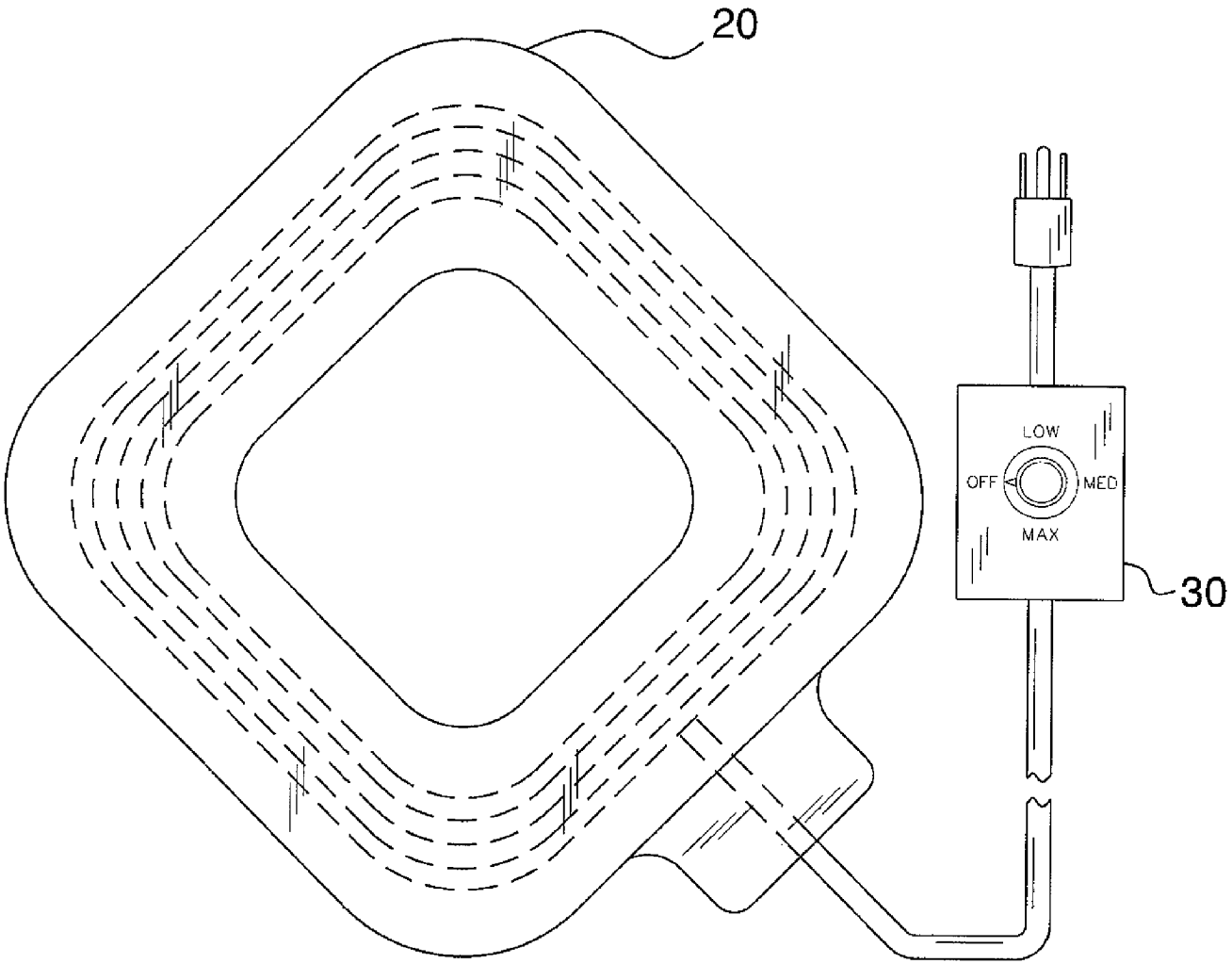
FIG. 2 is a top view of the heating member of an embodiment of the disclosure.
Figure 3:
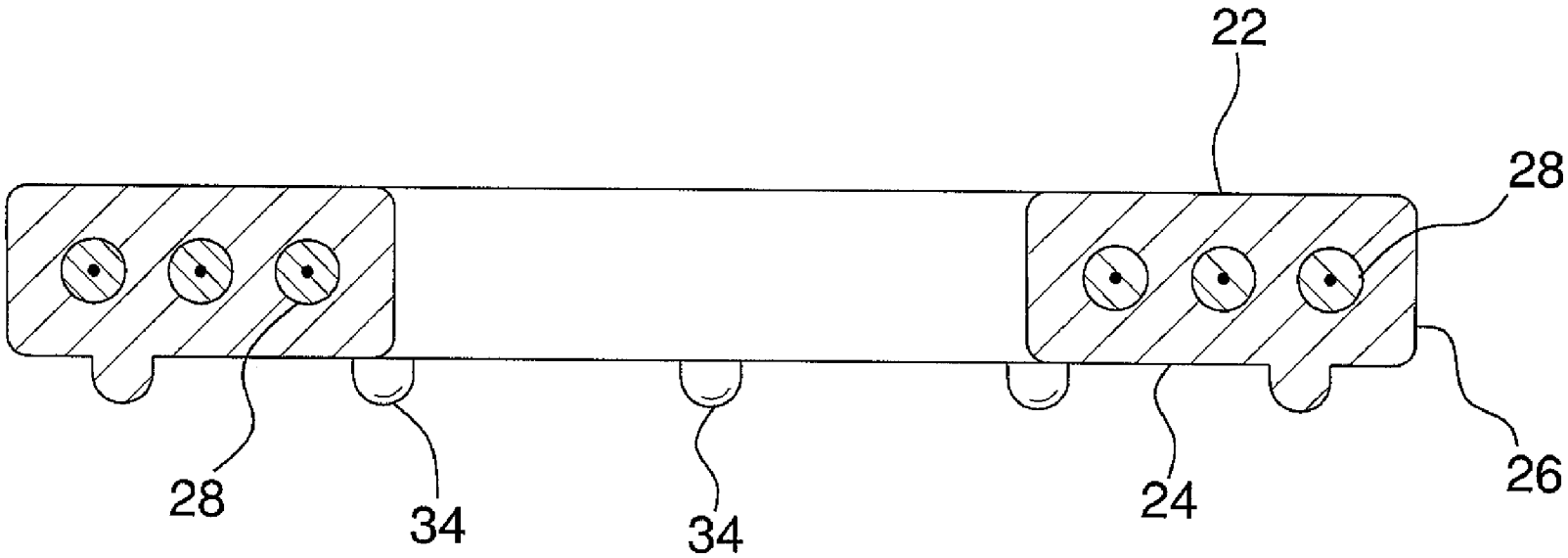
FIG. 3 is a cross-sectional view taken along line 3-3 of FIG. 1 of an embodiment of the disclosure.
Figure 4:
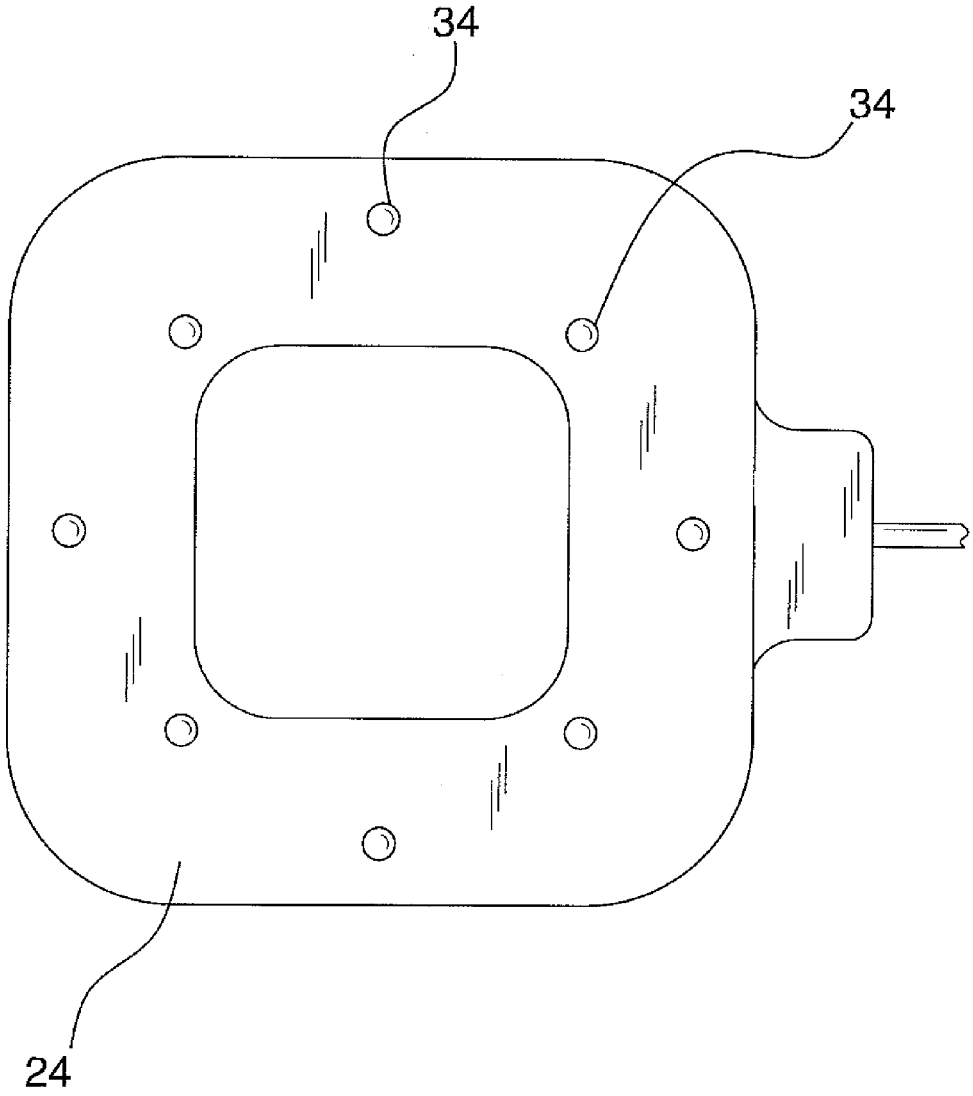
FIG. 4 is a bottom view of a housing of an embodiment of the disclosure.
Figure 5:
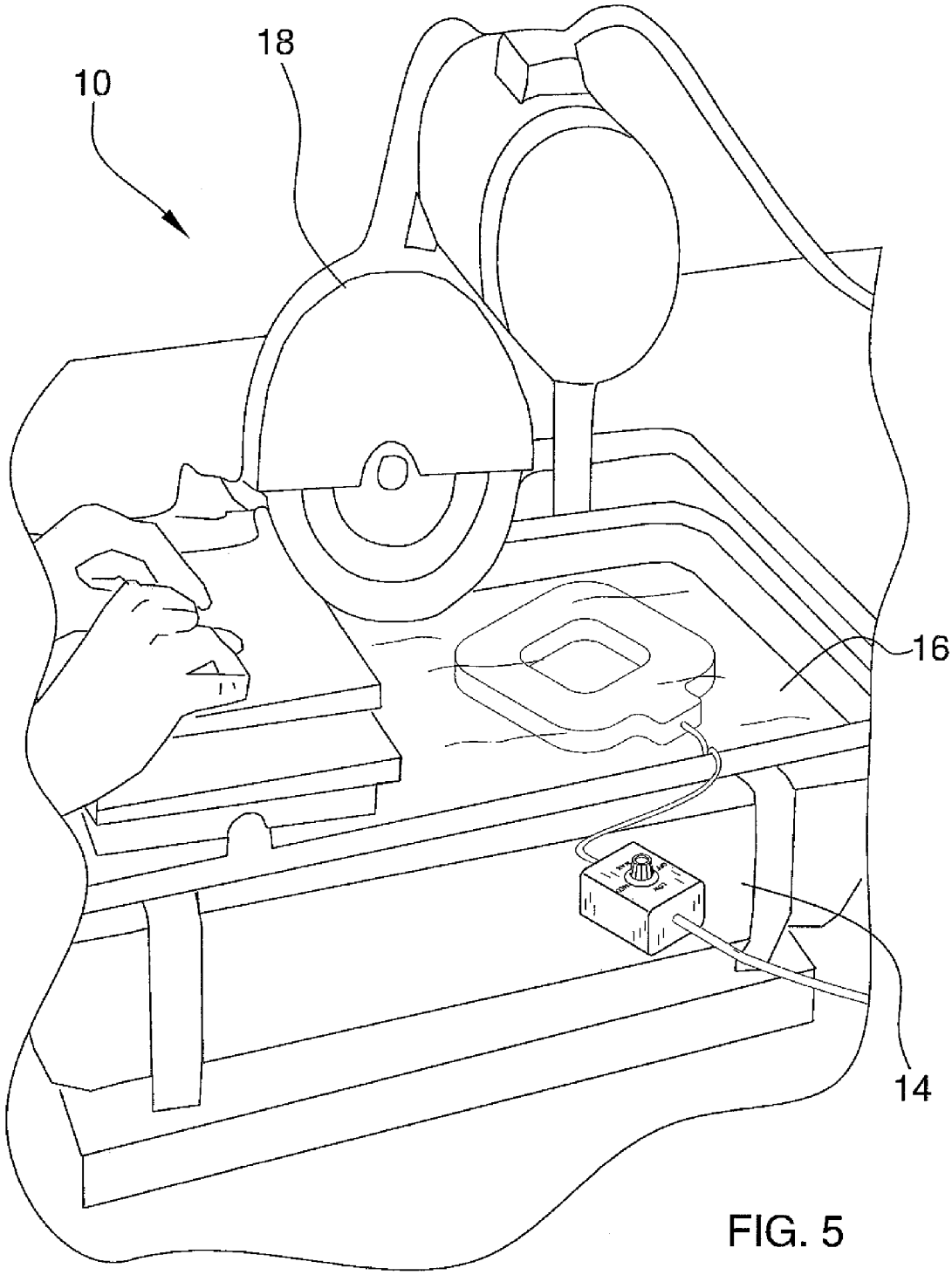
FIG. 5 is a perspective view of an embodiment of the disclosure.

With reference now to the drawings, and in particular to FIGS. 1 through 5 thereof, a new ice preventing method embodying the principles and concepts of an embodiment of the disclosure and generally designated by the reference numeral 10 will be described.

As best illustrated in FIGS. 1 through 5, the saw bath ice formation preventing method 10 generally comprises positioning a heating member 12 in a basin 14 having water 16 positioned therein. A conventional wet saw 18, such as used for cutting ceramic tile, is mounted to the basin 14. The heating member 12 comprises a housing 20 that has an upper surface 22, a lower surface 24 and a perimeter surface 26 extending between the upper 22 and lower 24 surfaces. A plurality of heating elements 28 is positioned within the housing 12. A control 30 is electrically coupled to the heating elements 28 to selectively alter a heat output of the heating elements 28. A power cord 32 is electrically coupled to the control 30 and is pluggable into an electric power socket. A plurality of foot members 34 is attached to and extends downwardly from the lower surface 24 to increase water circulation around the housing 20.

In use, the heating member 12 is turned on when the wet saw 18 is used in temperatures below 0° Celsius to prevent the water 16 from freezing. This allows a person cutting tile outside in cold temperatures, or inside a dwelling without heat, to allow for proper operation of the wet saw 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A method of preventing ice formation in a wet saw basin comprising the steps of: positioning a heating member in a basin having water positioned therein, mounting a wet saw to said basin, said heating member comprising a housing having an upper surface, a lower surface and a perimeter surface extending between said upper and lower surfaces, positioning a plurality of heating elements within said housing, electrically coupling a control to said heating elements, selectively altering a heat output of said heating element; and turning on said heating member when said wet saw is being used in temperatures below 0° Celsius to prevent the water from freezing.

2. A method of preventing ice formation in a wet saw basin comprising the steps of: positioning a heating member in a basin having water positioned therein, mounting a wet saw to said basin, said heating member comprising a housing having an upper surface, a lower surface and a perimeter surface extending between said upper and lower surfaces, a plurality of heating elements being positioned within said housing, coupling a control electrically to said heating elements, selectively altering a heat output of said heating elements, coupling a power cord electrically to said control, attaching a plurality of foot members to and extending downwardly from said lower surface; and turning on said heating member when said wet saw is being used in temperatures below 0° Celsius to prevent the water from freezing.

3. A wet saw and heating combination assembly comprising:

a heating member;

a basin having said heating member positioned therein, said heating member comprising a housing having an upper surface, a lower surface and a perimeter surface extending between said upper and lower surfaces, a plurality of heating elements being positioned within said housing, a control being electrically coupled to said heating elements to selectively alter a heat output of said heating elements, a power cord being electrically coupled to said control, a plurality of foot members being attached to and extending downwardly from said lower surface;

a wet saw being coupled to said basin; and wherein said basin is constructed to hold water for the wet saw and said heater retains the water at a temperature to prevent the water from freezing.

4. The assembly according to claim 3, further including a plurality of foot members being attached to and extending downwardly from said lower surface.

* * * * *